US008033320B2

(12) United States Patent
Gigliotti et al.

(10) Patent No.: US 8,033,320 B2
(45) Date of Patent: Oct. 11, 2011

(54) HIGH EMITTANCE SHELL MOLDS FOR DIRECTIONAL CASTING

(75) Inventors: Michael Francis Xavier Gigliotti, Scotia, NY (US); Shyh-Chin Huang, Latham, NY (US); Adegboyega Masud Makinde, Niskayuna, NY (US); Roger John Petterson, Fultonville, NY (US); Stephen Francis Rutkowski, Duanesburg, NY (US); Venkat Subramaniam Venkataramani, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 631 days.

(21) Appl. No.: 12/179,749

(22) Filed: Jul. 25, 2008

(65) Prior Publication Data

US 2010/0018666 A1 Jan. 28, 2010

(51) Int. Cl.
*B22C 1/02* (2006.01)

(52) U.S. Cl. ..... 164/519

(58) Field of Classification Search ..... 164/516–519, 164/361, 529

See application file for complete search history.

(56) References Cited

U.S. PATENT DOCUMENTS

| | | | |
|---|---|---|---|
| 3,583,468 | A | 6/1971 | Cutler |
| 3,973,750 | A | 8/1976 | Rabinovitch et al. |
| 4,026,344 | A | 5/1977 | Greskovich |
| 4,247,333 | A | 1/1981 | Ledder et al. |
| 4,436,485 | A | 3/1984 | Vonnegut |
| 5,297,615 | A | 3/1994 | Almone et al. |
| 5,391,606 | A | 2/1995 | Doles |
| 5,677,371 | A | 10/1997 | Guerra, Jr. |
| 5,680,895 | A | 10/1997 | Frasier |
| 5,738,819 | A | 4/1998 | Feagin |
| 6,814,131 | B2 | 11/2004 | Vandermeer |
| 7,128,129 | B2 | 10/2006 | McGuire |
| 7,296,616 | B2 | 11/2007 | Bewlay et al. |
| 2006/0130996 | A1 | 6/2006 | Bewlay et al. |

FOREIGN PATENT DOCUMENTS

| | | |
|---|---|---|
| RU | 2231418 C1 | 6/2004 |
| RU | 2245212 C1 | 1/2005 |

OTHER PUBLICATIONS

Abstract for RU2231418C1, located https://www.delphion.com/details?pn-RU02231418C1, dated Jul. 25, 2008, 2 pgs.
Abstract for RU2245212C1, located https://www.delphion.com/details?pn-RU02245212C1, dated Jul. 25, 2008, 2 pgs.
EP 09165853, EP Search Report, Oct. 2, 2009.

*Primary Examiner* — Jessica L Ward
*Assistant Examiner* — Steven Ha
(74) *Attorney, Agent, or Firm* — Ann M. Agosti

(57) ABSTRACT

Shell molds and processes for making the shell molds that exhibit high emissivity in the red and infrared regions. In this manner, thermal resistance within a gap formed between solidifying cast metal and the interior mold surface is decreased. In one embodiment, the facecoat region is formed from a slurry composition comprising an aluminum oxide, a green chromium oxide and a silicon dioxide. In another embodiment, the facecoat region is formed from a slurry composition including zirconium silicate and silica with stucco layer of alumina is included.

9 Claims, 21 Drawing Sheets

0% Cr 1650° C 2HRS

Dark Gray Area

Gray Area

Light Area

Gray Area

3% Cr 1650°C 2HRS

1μm

Light Area

Dark Area

Gray Area

Light Gray Area

3% Cr 1650°C 2HRS

6% Cr 1650°C 2HRS

Light Area

Dark Gray Area

Light Gray Area

Light Area

6% Cr 1650°C 2HRS

9% Cr 1650°C 2HRS

9% Cr 1650°C 2HRS

1μm

White Area

Gray Area

Light Gray Area

Light Area

Base mold
1000°C 1h AC
1550°C 1h AC

82574C: 1550°C secondary coat —— 20μm

82574C: 1550°C Zircon face-coat —— 20μm

HIGH EMITTANCE SHELL MOLDS FOR DIRECTIONAL CASTING

BACKGROUND

The present disclosure generally relates to shell molds for directional casting, and more particular, to high emittance shell mold compositions that provide a high thermal gradient.

In the manufacture of components, such as nickel based superalloy turbine blades and vanes for turbine engines, directional solidification (DS) investment casting techniques have been employed in the past to produce columnar grain and single crystal casting microstructures having improved mechanical properties at the high temperatures encountered in the turbine section of the engine.

For directional solidification of superalloys, the solid-liquid interface needs a high thermal gradient to yield good cast microstructure. In order to provide a high thermal gradient, heat needs to be removed from the solid casting. However, during the casting process, the metal shrinks away from the mold after the metal solidifies upon cooling; thus, the heat must radiate across an air gap from the surface of the metal to the surface of the mold, from where it can be conducted away. The shrinkage associated with solidification and cooling is a consideration for many casting processes as it affects the casting dimensions and the formation of hot tear cracks as well as contributing to other defects. In continuous casting processes, the molds are often tapered to account for the shrinkage but generally require a fundamental understanding of the shrinkage phenomena during the solidification and cooling of a solidifying shell.

Conventional mold ceramics are selected for strength and chemical inertness. For directional solidification of superalloys, the mold material is typically selected from quartz, fused silica, zircon, alumina, aluminosilicate, and yttria. Typically the process for forming the molds includes dipping a wax pattern into a slurry comprising a binder and a refractory material, so as to coat the pattern with a layer of slurry. The binder is often a silica-based material. Colloidal silica is very popular for this purpose, and is widely used for investment-casting molds. Commercially available colloidal silica grades of this type often have a silica content of approximately 10%-50%. Oftentimes a stucco coating of dry refractory material is then applied to the surface of the slurry layer. The resulting stucco-containing slurry layer is allowed to dry. Additional slurry-stucco layers are applied as appropriate, to create a shell mold around the wax model having a suitable thickness. After thorough drying, the wax model is eliminated from the shell mold, and the mold is fired.

Sometimes, before the shell has cooled from this high temperature heating, the shell is filled with molten metal. Alternately, the mold is cooled to room temperature, and is stored for later use. Subsequent re-heating of the mold will be controlled so as not to cause cracking. Various methods have been used to introduce molten metal into shells including gravity, pressure, vacuum and centrifugal methods. When the molten metal in the casting mold has solidified and cooled sufficiently, the casting may be removed from the shell.

Facecoats are sometimes used to form a protective barrier between the molten casting metal and the surface of the shell mold. For example, U.S. Pat. No. 6,676,381 (Subramanian et al.) describes a facecoat based on yttria or at least one rare earth metal and other inorganic components, such as oxides, silicides, silicates, and sulfides. The facecoat compositions are most often in the form of slurries, which generally include a binder material along with a refractory material such as the yttria component. When a molten reactive casting metal is delivered into the shell mold, the facecoat prevents the undesirable reaction between the casting metal and the walls of the mold, i.e., the walls underneath the facecoat. Facecoats can sometimes be used, for the same purpose, to protect the portion of a core (within the shell mold), which would normally come into contact with the casting metal.

The solidification rate of the molten metal in an investment casting mold significantly affects the microstructure, strength, and quality of the casting. If the solidification rate is too rapid, the metal may not have enough time to feed liquid metal to accommodate the shrinkage on solidification, resulting in porosity. If the solidification rate is too slow, the casting may exhibit a coarse microstructure. Applicants have discovered that these drawbacks, as well as others, may be avoided or minimized by controlling the cooling rate of the molten metal in an investment casting mold.

Accordingly, there remains a need for molds having high heat emittance so as to provide good cast microstructure.

BRIEF SUMMARY

Disclosed herein are high emittance mold shells and processes for forming the high emittance mold shells. In one embodiment, a shell mold for casting molten material to form an article comprises a facecoat disposed on an inner surface of the shell mold that contacts the molten material during use thereof, said facecoat having a phase comprising a high-emissivity alumina solid solution, wherein the high emissivity alumina solid solution is substantially mullite and corundum.

In another embodiment, a shell mold for casting molten material to form an article comprises a facecoat disposed on an inner surface of the shell mold that contacts the molten material during use thereof, said facecoat having a phase comprising a high-emissivity alumina solid solution, wherein the high emissivity alumina solid solution is formed from a slurry comprising zirconium silicate and colloidal silica with a stucco comprising aluminum oxide.

A process for forming a shell mold, the process comprises preparing a fugitive pattern; dipping said pattern in a slurry composition to form a facecoat layer contacts the fugitive pattern, the slurry composition comprising an aluminum oxide, a green chromium oxide, and a silicon dioxide; depositing a stucco layer onto the facecoat layer; drying the shell; and firing the shell at a temperature greater than a melting point of a metal to be cast.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Figure 1:
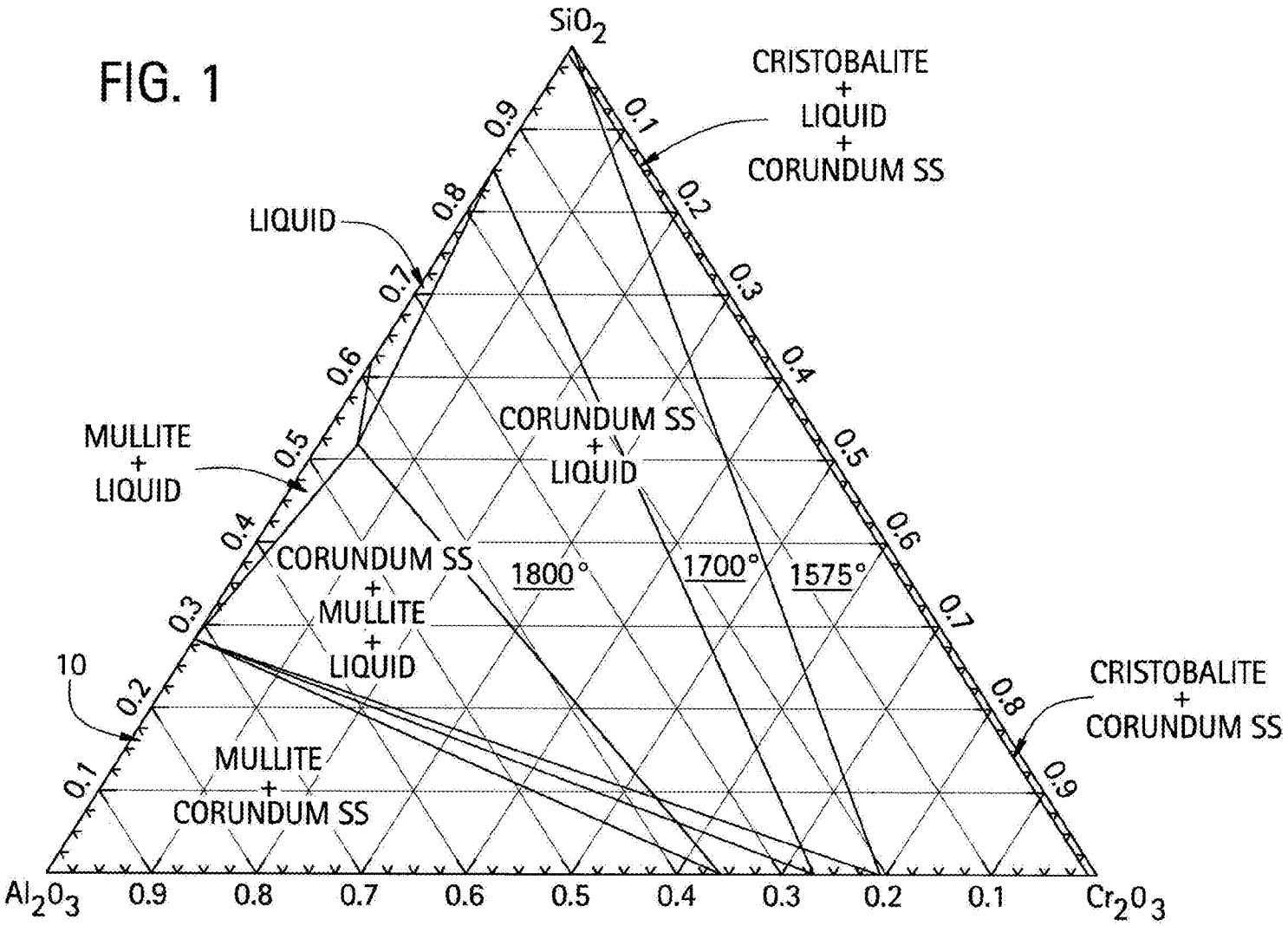
FIG. 1 is a ternary phase diagram for an aluminum oxide, a green chromium oxide, and a silicon dioxide composition.

Disclosed herein are casting molds that exhibit high heat emittance in the red and infrared portions of the electromagnetic spectrum. The facecoat of the casting mold includes emissive compounds that advantageously increase the ability of the mold to transfer heat to its surroundings during use thereof. In one embodiment, the facecoat composition includes the addition of green chromium (III) oxide to an alumina silica ($Al_2O_3$—$SiO_2$) mold slurry, which, as will be described in greater detail below, yields a high emissive ceramic mold upon firing and has exhibited an emittance greater than the emittance of the base alumina-silica slurry without the green chromium oxide. In this embodiment, the mold ceramic comprises layers of $Al_2O_3$—$Cr_2O_3$—$SiO_2$ with a stucco of $Al_2O_3$. In another embodiment, the composition includes the addition of zirconium oxide to an alumina-silica slurry. In still another embodiment, the casting mold composition includes the addition of white titanium dioxide to an alumina-silica slurry, which yields a black, highly-emissive ceramic mold. In these embodiments, the mold ceramic can further include the addition of refractory oxides to the $Al_2O_3$—$SiO_2$ slurries including, but not limited to, $Fe_2O_3$, FeO, $TiO_2$, TaC, TiC, SiC, HfC, ZrC, and the like as well as oxides thereof. In still other embodiments, the mold ceramic comprises layers of $Al_2O_3$—$ZrO_2$—$SiO_2$ (doped with $Cr_2O_3$ and/or $TiO_2$) with a stucco of $Al_2O_3$.

The general steps used to form the molds with the slurries as generally described above include forming the desired pattern by conventional methods. For example, a mold can be formed about a fugitive (removable) pattern having the shape of the cast part desired. By way of example, in making a turbine blade or vane casting, the pattern will have the configuration of the turbine blade or vane desired. The pattern may be made of wax, plastic, or other removable material as noted above.

A primary mold facecoat layer for contacting the molten metal or alloy to be cast is first formed on the pattern typically by dipping the pattern in a ceramic slurry (coating), the composition of which is discussed above, draining excess slurry from the pattern, and then stuccoing the ceramic slurry while wet with relatively coarse ceramic particulates (stucco). One or more secondary layers may be formed on the facecoat layer by repeating the sequence of dipping the pattern in the ceramic slurry, draining excess slurry, and stuccoing the requisite number of times corresponding to the number of layers desired. In one embodiment, each slurry/stucco layer is dried prior to carrying out the next coating and stuccoing operation. The facecoat layer and each secondary layer, if present, include an inner region comprising the dried ceramic slurry and outer region comprising the ceramic stucco.

In one embodiment, the particular ceramic slurry for forming the one or more facecoat layers includes aluminum oxide, silicate, and green chromium oxide. In these embodiments, the ceramic stucco can be formed of aluminum oxide ($Al_2O_3$). Both $Al_2O_3$ and green $Cr_2O_3$ are commercially available as dry particles, i.e., flour, in a variety of mesh sizes. For example, the alumina can be a high-purity alumina greater than 98% by weight $Al_2O_3$. The $Al_2O_3$ flour, when the mold is employed for the casting and directional solidification of turbine components having a high standard of surface finish requirements, can be acid-washed to remove impurities, such as iron, which is detrimental to the formulation of a suitable primary slurry. Grain sizes are considered since surface finish of molds and mold permeability is important when an acceptable casting is desired. A flour mixture containing a high percentage of large grains will produce a rough inner mold wall. This roughness is reproduced on the casting surface. Flour containing a large percentage of "fines" can need an excessive amount of binder and may cause mold wall "buckling". Thus, a careful balance is made as to the mesh sizes used.

In one embodiment, the $Al_2O_3$ flour has a mesh size of −240 mesh (less than about 60 microns) and the green $Cr_2O_3$ flour has a mesh size −240 mesh (less than about 60 microns).

The silica is preferably in the form of colloidal silica. Colloidal silica materials are commercially available from many sources, such as Nalco Chemical Company and Dupont. Non-limiting examples of such products are described by Horton in U.S. Pat. No. 4,947,927. The colloidal solution is usually diluted with deionized water, to vary the silica content.

In one embodiment, the slurry composition includes aluminum oxide in an amount from 70 to about 95 percent by weight, green chromium (III) oxide in an amount greater than 0.5 to 10% by weight, and the silicon dioxide in an amount of greater than 0 to about 27% wherein the amounts by weight are based on a total solid contents of the dried slurry composition. In another embodiment, the slurry composition includes aluminum oxide in an amount from 75 to 91 percent by weight, chromium (III) oxide in an amount from 2 to 9% by weight, and colloidal silica in an amount of about 6 to about 16% by weight. In still another embodiment, the slurry composition includes aluminum oxide in an amount from 79 to 90 percent by weight, chromium (III) oxide in an amount from 3 to 6% by weight, and colloidal silica in an amount of about 7 to about 15% by weight. This mixture can be applied by dipping or brushing the fugitive pattern with the slurry.

FIG. 1 illustrates a phase diagram of the ternary $Al_2O_3$—$Cr_2O_3$—$SiO_2$ composition. As shown, the region of interest 10, wherein the ternary composition is of a solid state (alumina solid solution phase) is at about the lower left hand portion of the phase diagram, which indicates a higher melting point for the composition range. In this region of interest 10, the ternary composition is in the solid state phase existing substantially as mullite and corundum. The melting point is in excess of 1800° C.

Advantageously, the highly emissive composition can be used to provide casting of refractory metal intermetallic composite (RMIC) materials as well as nickel based superalloys. Examples of applicable RMIC materials include various niobium-silicon alloys (sometimes referred to as "niobium-silicides"). The RMIC materials may also include a variety of other elements, such as titanium, hafnium, aluminum, and chromium. Such materials generally have much greater temperature capabilities than the current class of superalloys. The melting point for a metal charge based on the RMIC materials will of course depend on the individual constituents of the RMIC, but is usually in the range of about 1500° C. to about 2100° C.

The slurry can include additional components as may be desired for some applications. For example, a wetting agent can be included to ensure proper wetting of the wax pattern by the slurry. Viscosity-control agents are also typically included. For example, a non-ionic wetting agent is generally preferred since these are compatible with the binder (colloidal silica) employed. Also, a defoaming agent may be added if excessive foam is noted on the slurry during the mixing operation. The resulting slurries are preferably maintained at a pH high enough to maintain stability. Various techniques can be used for this purpose, e.g., the addition of metal hydroxides or organic hydroxides.

Optionally, a refractory metal, carbide, and/or alloyed oxides thereof can be added or may be used in place of the chromium (III) oxide. Suitable refractory metals, carbides, and alloyed oxides include, without limitation, FeO, $Fe_2O_3$, $TiO_2$, TaC, TiC, SiC, HfC, ZrC, and the like.

The slurries described herein are prepared by standard techniques, e.g., using conventional mixing equipment. For example, they can be prepared by mixing the aqueous-based binder, such as colloidal silica, with the metal or metal oxide (e.g., aluminum oxide and green chromium oxide), and other desired additives, e.g., one or more compounds to maintain the pH at a desired level, as mentioned above.

Figure 2:
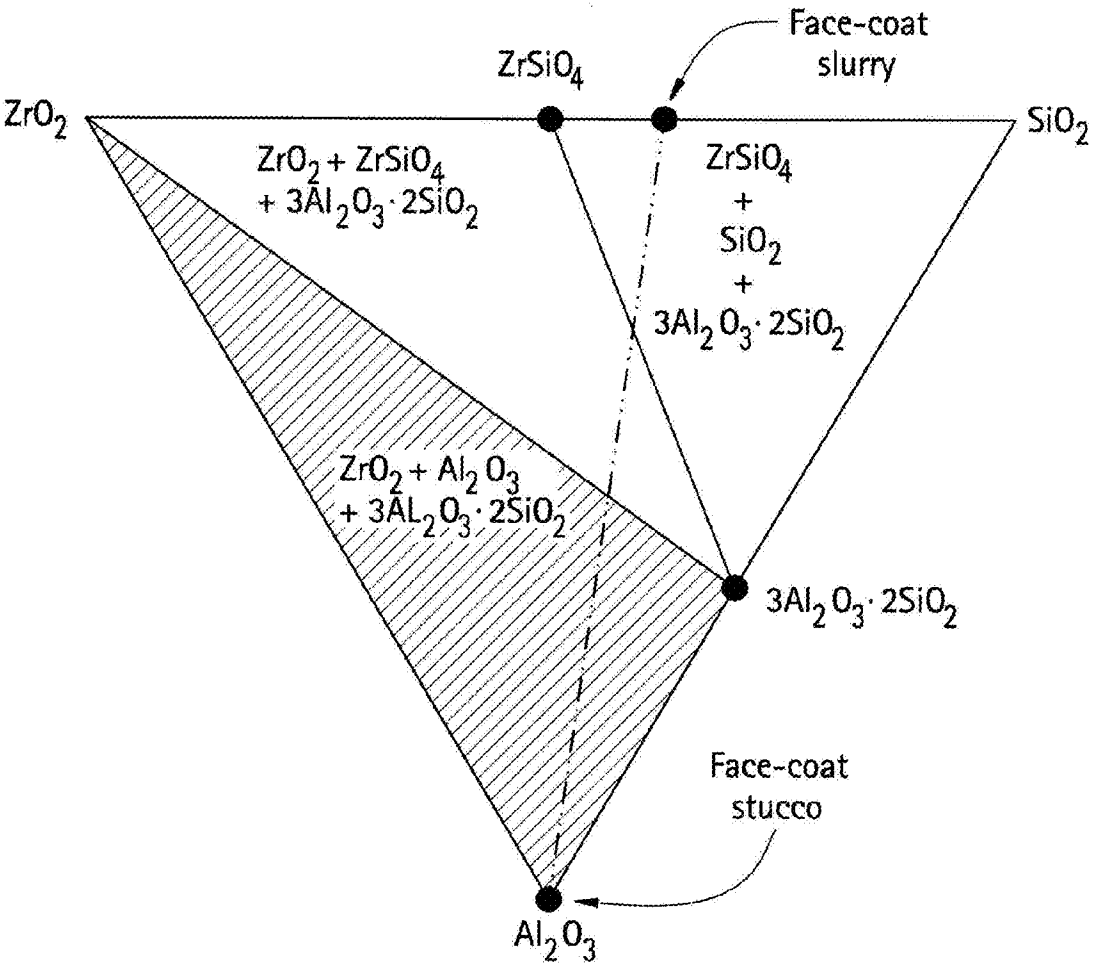
FIGS. 2-3 are ternary phase diagrams for an aluminum oxide, a zirconium oxide, and a silicon dioxide composition.
Figure 3:
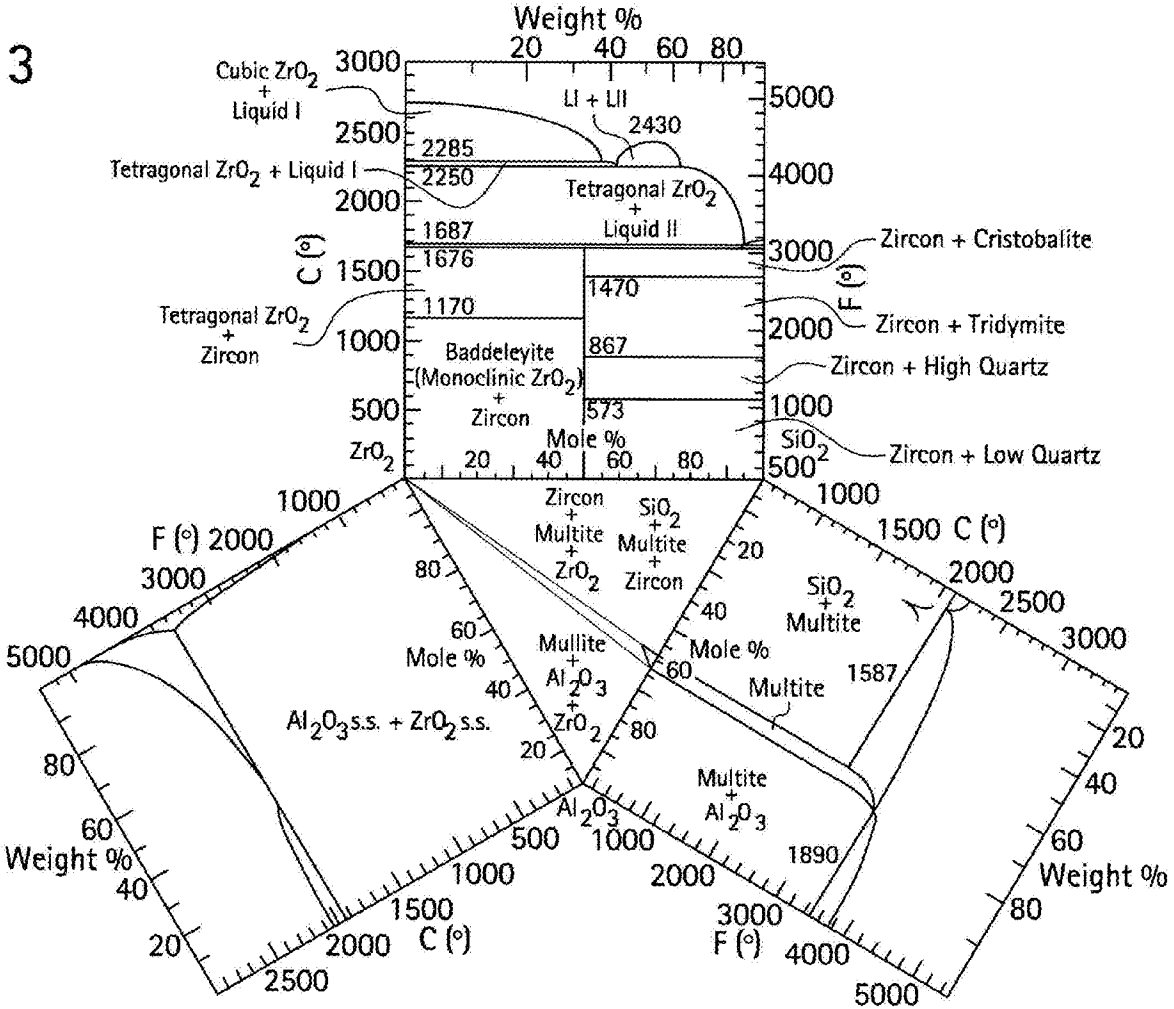

In another embodiment, the facecoat slurry composition includes zirconium silicate ($ZrSiO_4$) in an amount from 70 to 95% by weight, and colloidal silica 5 to about 30% by weight, wherein the weight percents are based on a total solid content of the slurry composition after drying. The stucco for this facecoat slurry would include alumina with green chromium (III) oxide, or alumina with titanium dioxide. FIGS. 2-3 provide ternary phase diagrams of the three components. As shown in FIG. 2, zirconium dioxide can develop in the facecoat region as a consequence of the diffusion couple between the slurry composition and the aluminum oxide based stucco.

In FIG. 3, the mold microstructure that is developed on heat treatment is described. There, the various microstructures as a function of mole percent are illustrated. With firing and interdiffusion, the initial phases of the slurry plus stucco, e.g., zircon, silica, and alumina (plus chromia or titania) interdiffuse to become a high-emissivity alumina-chromia or alumina-titania solid solution, plus zirconium dioxide plus mullite (i.e., aluminum silicate), and provide the mold with high emittance properties.

In a typical embodiment for making the ceramic shell molds of this disclosure, a wax pattern having a shape and configuration corresponding to a desired mold cavity is dipped into the slurry. The wet coating of slurry is then at least partially dried, to form a covering over the wax pattern. This covering serves as the first layer of the facecoat. The pattern is then repetitively dipped into the slurry, to build up the facecoat to a desired thickness.

In some embodiments, the facecoat comprises layers with varying compositions or particle sizes. For example, one layer could be formed of one silicate material such as aluminum silicate, while an adjacent layer might be formed from zirconium silicate. Furthermore, one or more layers may comprise fine particle size materials, while one or more layers may comprise coarse particles, e.g., those having an average particle size of greater than about 50 microns, and sometimes, greater than about 100 microns. The layers (usually, about 2 to 8 for the facecoat) could continue to alternate. The presence of the stucco layers is helpful in providing greater strength to the mold when such an attribute is required.

The overall thickness of the facecoat will depend on various factors. They include the particular composition of the facecoat material, as well as the metal being cast in the completed mold. Usually, the facecoat has a thickness (after the mold is fired) of about 0.05 mm to about 2 mm.

After formation of the facecoat, additional material is deposited on the fugitive pattern, to build up the mold walls. In a typical embodiment, the fugitive pattern is dipped in either the same facecoat slurry, or a different slurry, or alternating combinations of multiple slurries.

The stucco aggregate is usually in the form of coarse particles having an average size of grain size of 200 mesh to 40 mesh. For example, the stucco material could comprise coarse particles of yttria or yttrium monosilicate or a combination thereof. The stucco material is an alumina-based composition. Such materials are known in the art and described, for example, in U.S. Pat. No. 4,247,333 (Ledder et al) and U.S. Pat. No. 6,352,101 (Ghosh et al), which are incorporated herein by reference. A commercially available material such as fused alumina, tabular alumina, or sintered alumina silicates, is often used, as described in the Ledder patent, and in U.S. Pat. No. 5,143,777 (Mills). Moreover, mixtures of alumina having two or more particle sizes ("flour sizes") can also be used.

The number of layers (i.e., secondary layers) applied over the facecoat will of course depend on the desired thickness of the shell mold. As a non-limiting example, about 4 to about 20 total slurry layer/stucco layer pairs are often used for the secondary layers. A typical shell mold, once fired, has a total wall thickness (i.e., from the inner wall to the outer wall, and including the facecoat) of about 0.25 cm to about 2.50 cm, and preferably, about 0.50 cm to about 1.0 cm The secondary layer set can be compositionally graded, so that properties are varied across the thickness of the shell mold wall. Other physical properties can also be adjusted by way of this compositional grading. For example, the proportionate increase in alumina concentration can be very beneficial when greater high temperature-creep resistance is desired. The outermost layers of the mold can continue to vary in terms of the alumina/chromium oxide/silicate ratio, or could stay at a set ratio. In some embodiments prompted by rigorous requirements for high-temperature mold stability, the secondary layers (e.g., about 2 to about 4 of them) farthest away from the facecoat may comprise at least about {90%} by weight alumina, may comprise substantially all alumina. Usually, the variation in layer composition is accomplished by the use of multiple slurries containing the desired ingredients for a given layer.

After the shell mold has been completed, the fugitive material is removed by any conventional technique used in a lost wax process. In the case when the fugitive material is a wax, for example, flash-dewaxing can be carried out by plunging the mold into a steam autoclave, operating at a temperature of about 100° C. to about 200° C. The autoclave is typically operated under steam pressure (about 90-120 psi), for about 10-20 minutes, although these conditions can vary considerably.

In some embodiments, the mold is then pre-fired. A typical pre-firing procedure involves heating the mold at about 800°

C. to about 1150° C., for about 30 minutes to about 4 hours. The shell mold can then be fired according to conventional techniques. The required regimen of temperature and time for the primary firing stage will of course depend on factors such as wall thickness, mold composition, silicate particle size, and the like. The time/temperature regimen for firing should be one which is sufficient to convert substantially all free silica remaining in the mold to one or more of the metal silicates described previously, such as yttrium silicate. Typically, firing is carried out at a temperature in the range of about 1200° C. to about 1800° C., and in other embodiment's, about 1400° C. to about 1700° C. The firing time can vary significantly, but is usually in the range of about 5 minutes to about 10 hours, and more often, about 1 hour to about 6 hours. In preferred embodiments, less than about 1% by weight free silica remains after this heat treatment, in either crystalline or non-crystalline (glass) form.

Advantageously, the casting molds as described above provide an improved thermal gradient during directional solidification casting processes, thereby improving casting quality. The spectral emittance of the mold surface is increased in the gap between the solid metal layer and the interior mold surface so as to lower thermal resistance.

The following examples are presented for illustrative purposes only, and are not intended to limit the scope of the invention.

EXAMPLE 1

In this example, molds were prepared from an alumina-silica slurry containing varying amounts of green chromium oxide. The slurries were first formed by mixing alumina powder, chromia powder, and colloidal silica. A shell was formed by dipping a fugitive pattern into the slurry and then sieving dry alumina grains onto the freshly dipped pattern. The steps of dipping the pattern into a refractory slurry and then sieving onto the freshly dipped pattern dry refractory grains may be repeated until the desired thickness of the shell is obtained. Each coat of slurry and grains were air-dried before subsequent coats are applied. The shell is then heated to a temperature of about 1000° C. for a period of time effective to stabilize the shell and then further heated to a temperature of 1650° C. for two hours to form the mold.

Figure 4:
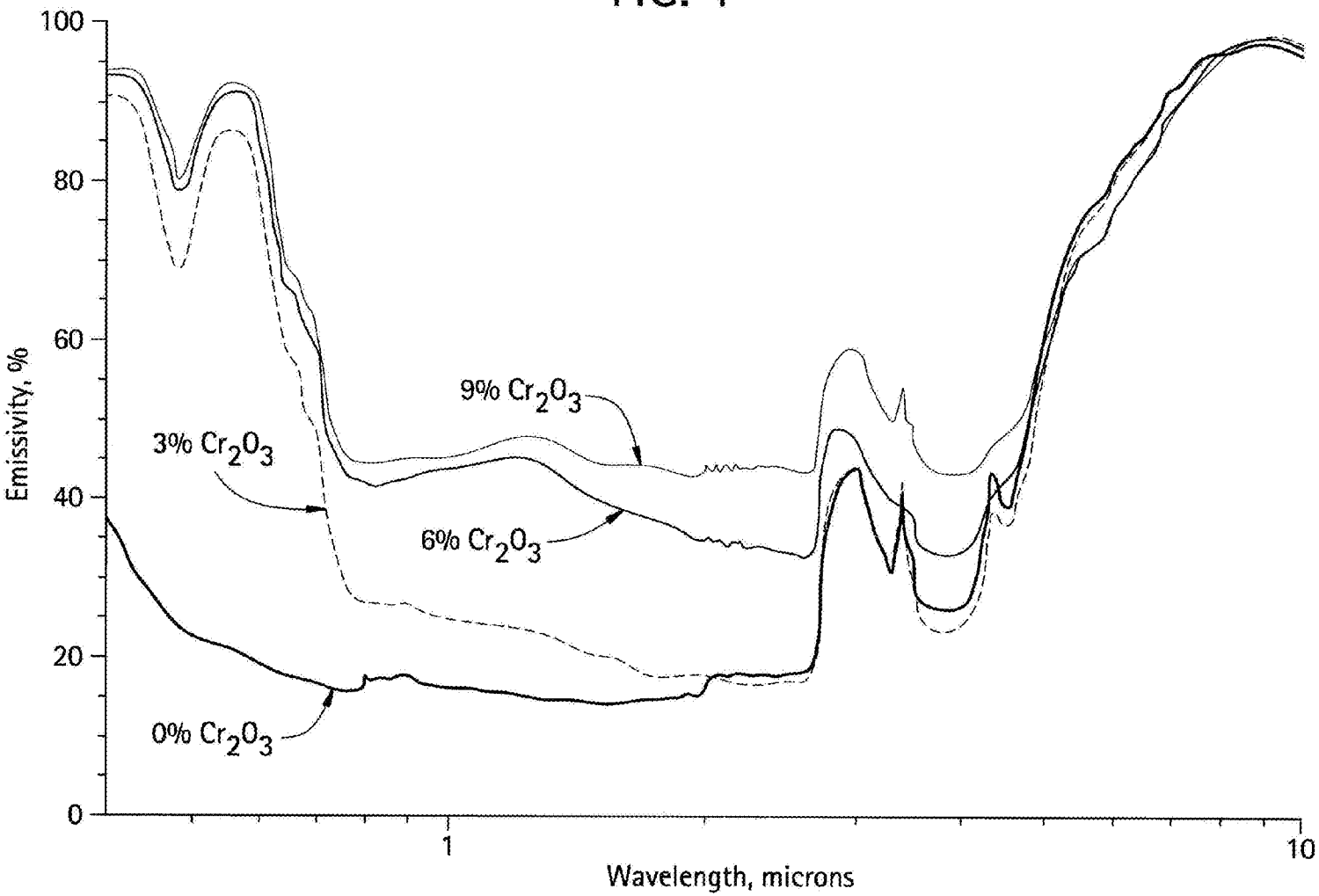
FIG. 4 graphically illustrates emittance as a function of wavelength for shell molds formed from a slurry composition of aluminum oxide, chromium oxide and silicon dioxide.
Figure 5:
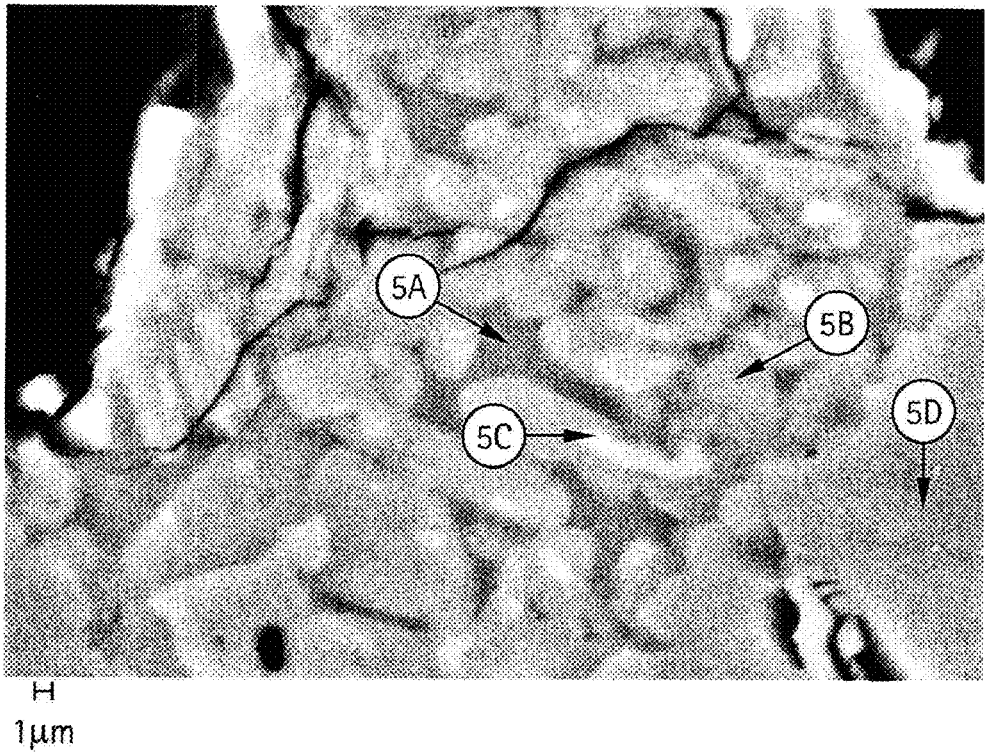
FIG. 5 provides a micrograph illustrating grain microstructure of a shell mold formed from a slurry composition of aluminum oxide and silicon dioxide and further includes qualitative elemental analysis by energy dispersive X-ray spectroscopy for different regions of the microstructure.
Figure 5A:
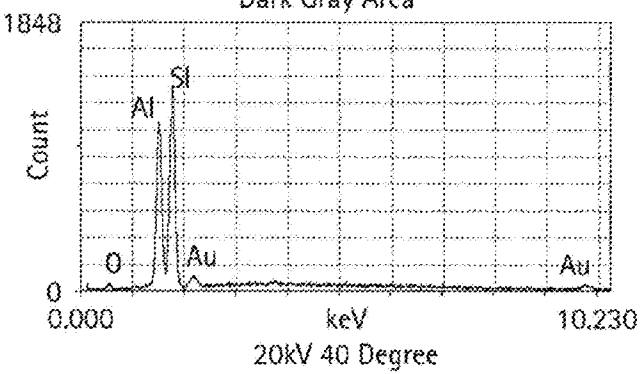
Figure 5B:
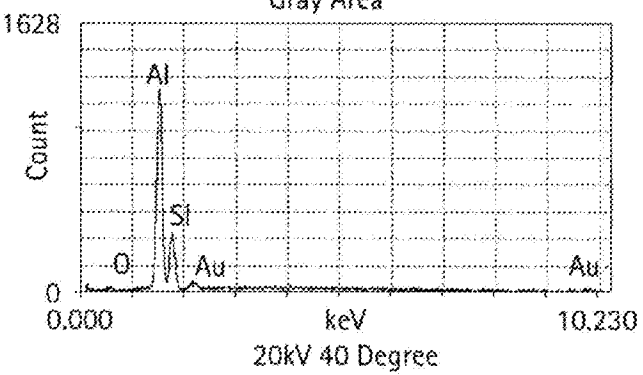
Figure 5C:
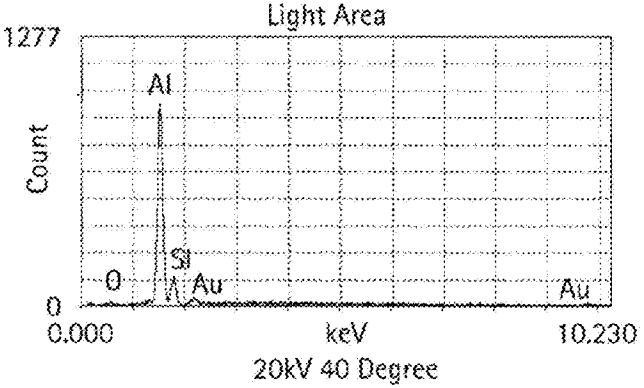
Figure 5D:
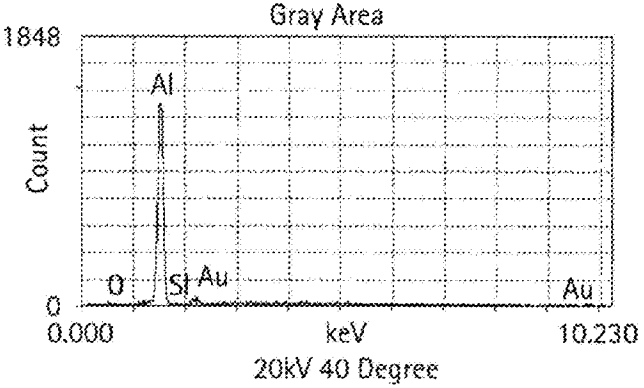
Figure 6:
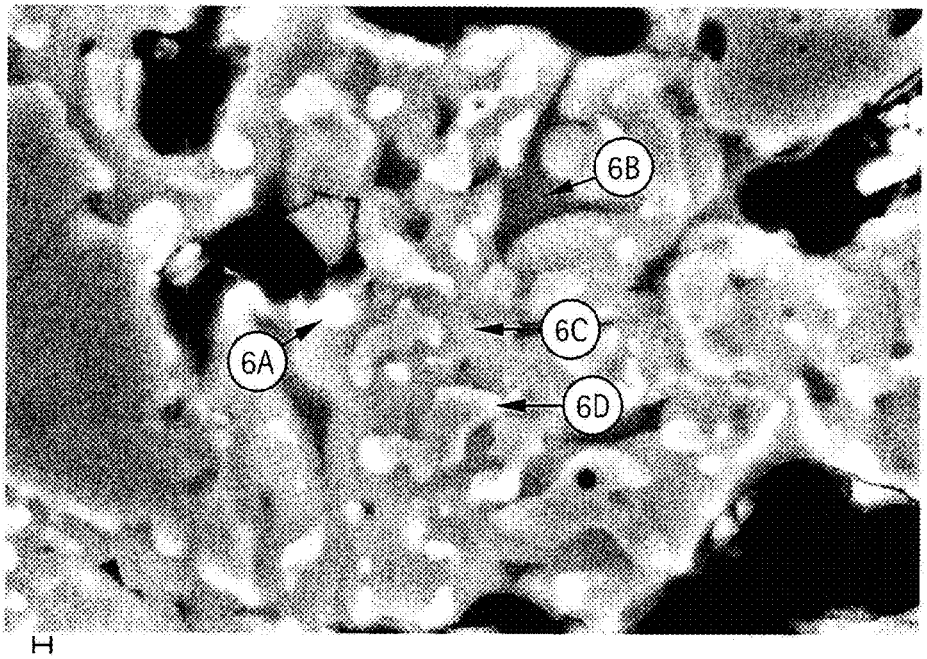
FIGS. 6-7 provides micrographs at two different resolutions illustrating grain microstructure of a shell mold formed from a slurry composition of aluminum oxide, 3% chromium oxide and silicon dioxide and further includes qualitative elemental analysis by energy dispersive X-ray spectroscopy for different regions of the microstructure.
Figure 6A:
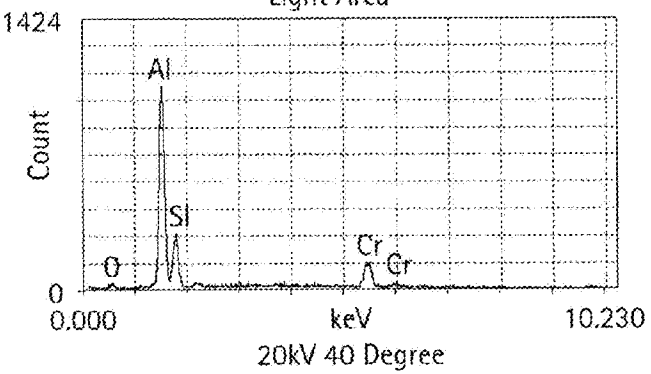
Figure 6B:
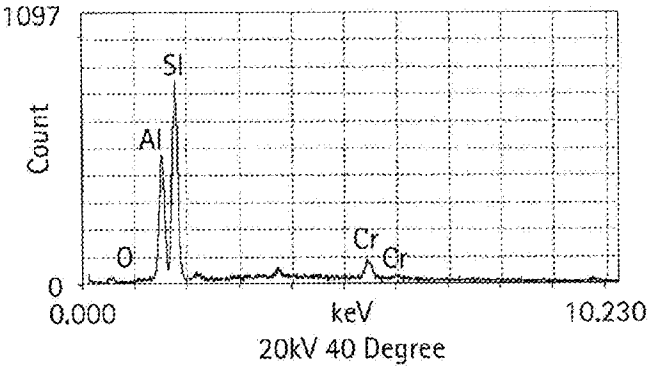
Figure 6C:
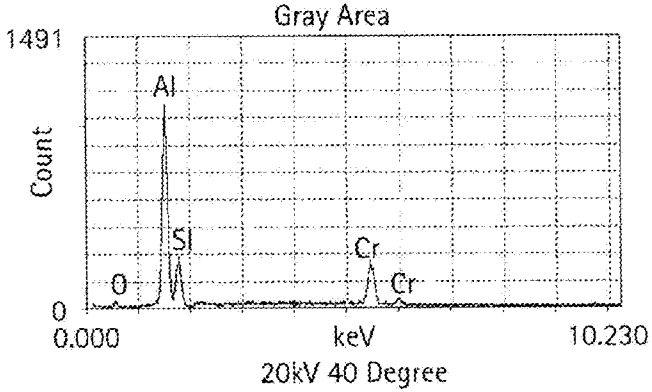
Figure 6D:
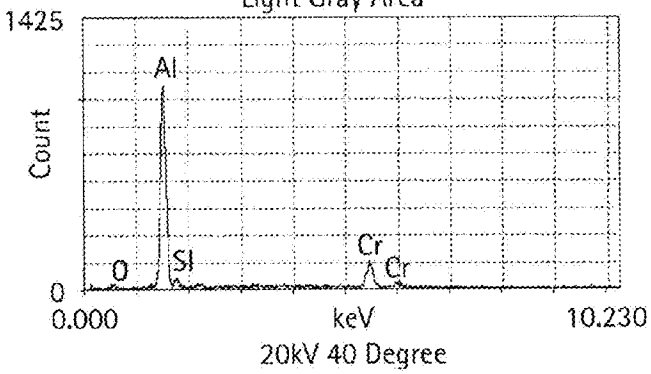
Figure 7:
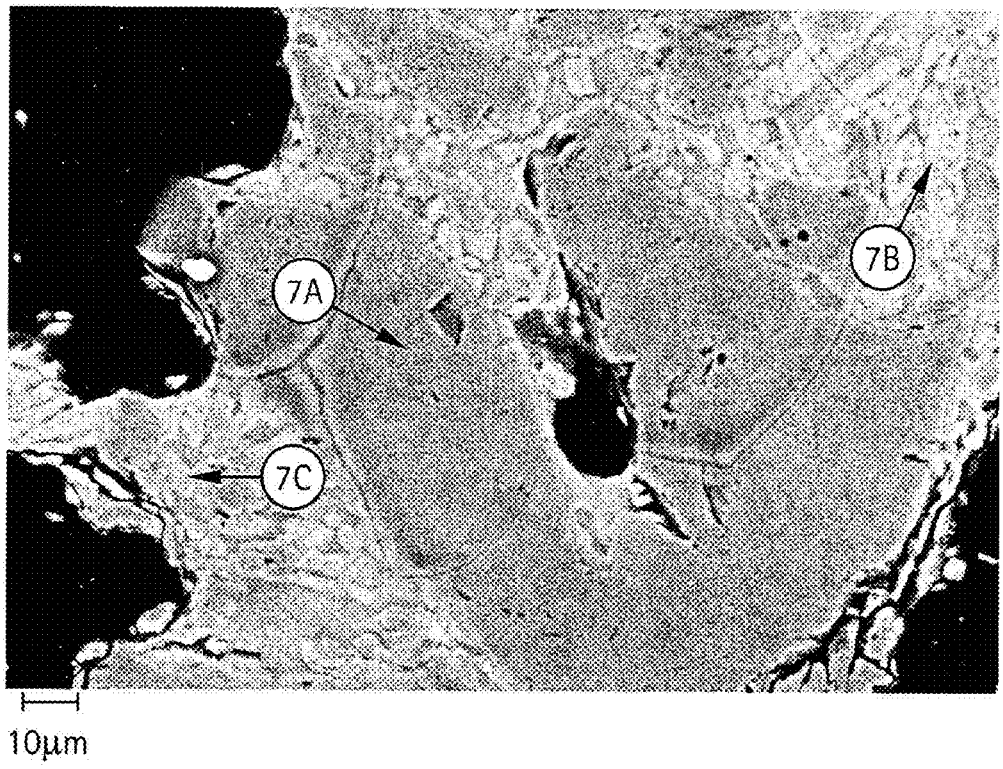
Figure 7A:
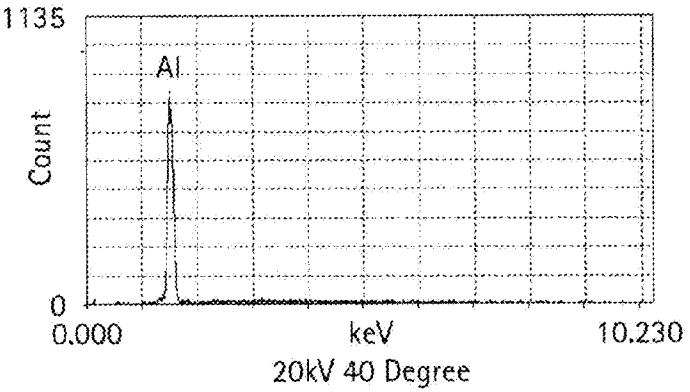
Figure 7B:
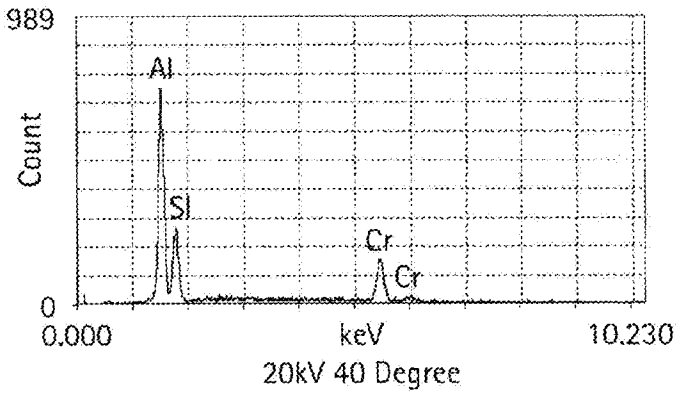
Figure 7C:
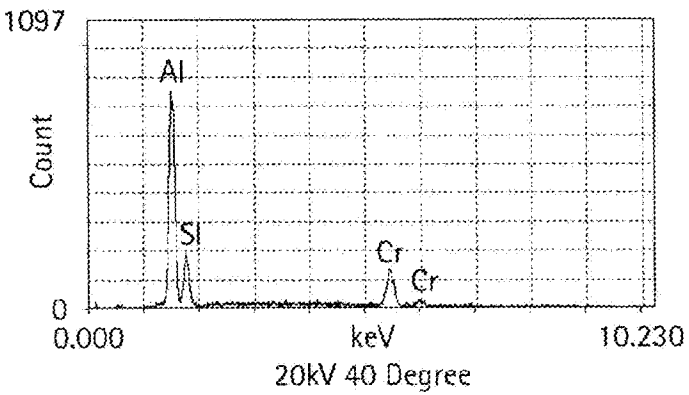
Figure 8:
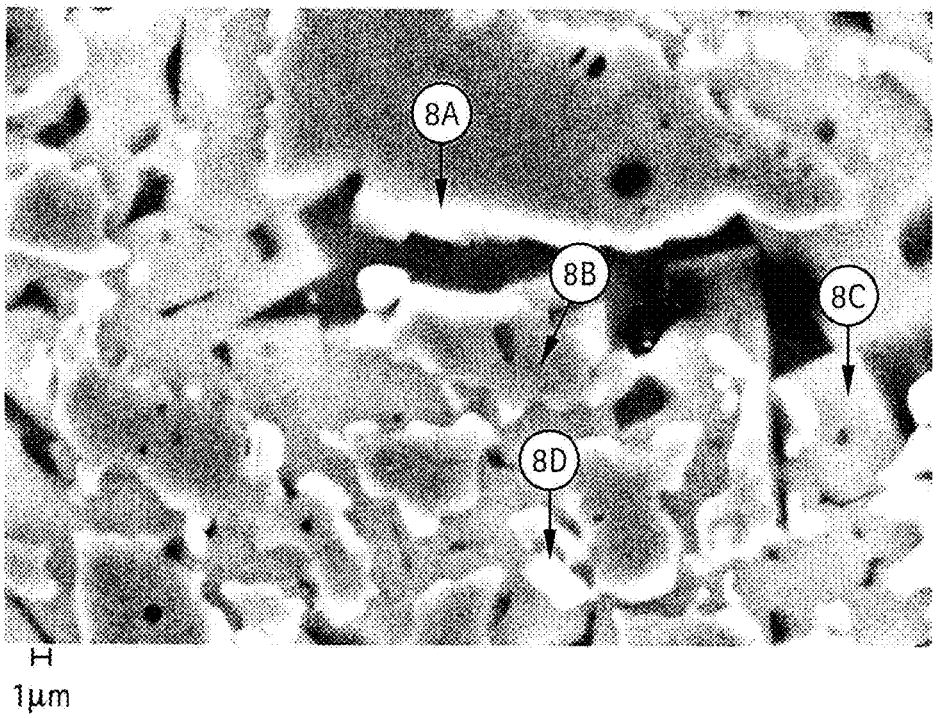
FIGS. 8-9 provides micrographs at two different resolutions illustrating grain microstructure of a shell mold formed from a slurry composition of aluminum oxide, 6% chromium oxide and silicon dioxide and further includes qualitative elemental analysis by energy dispersive X-ray spectroscopy.
Figure 8A:
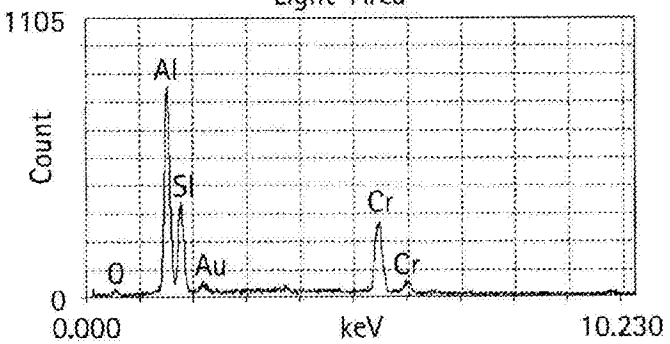
Figure 8B:
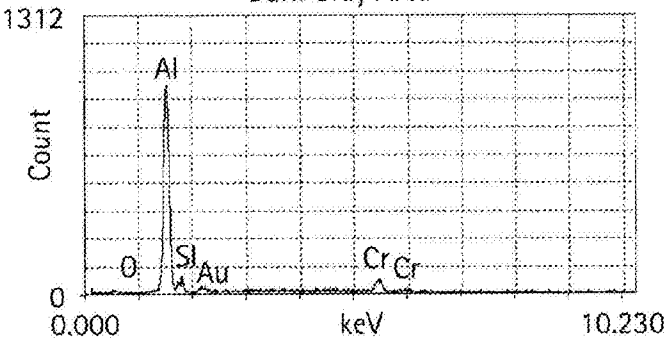
Figure 8C:
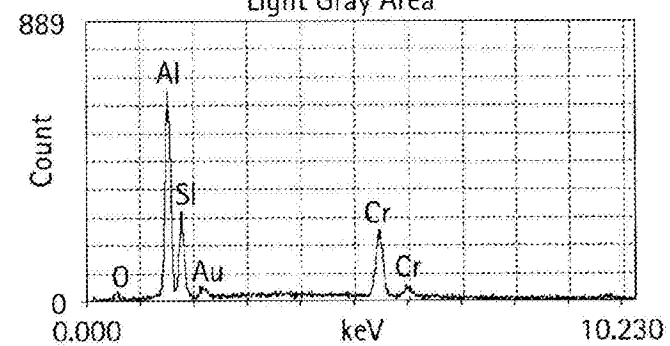
Figure 8D:
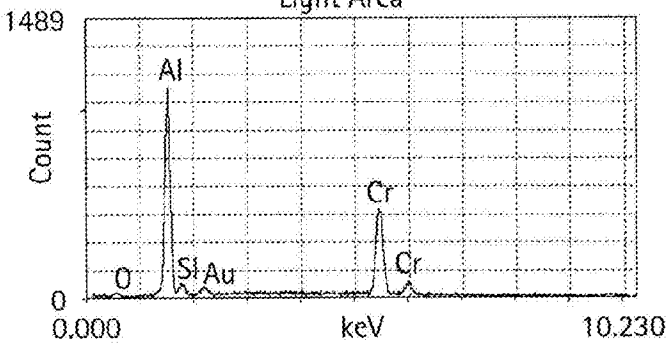
Figure 9:
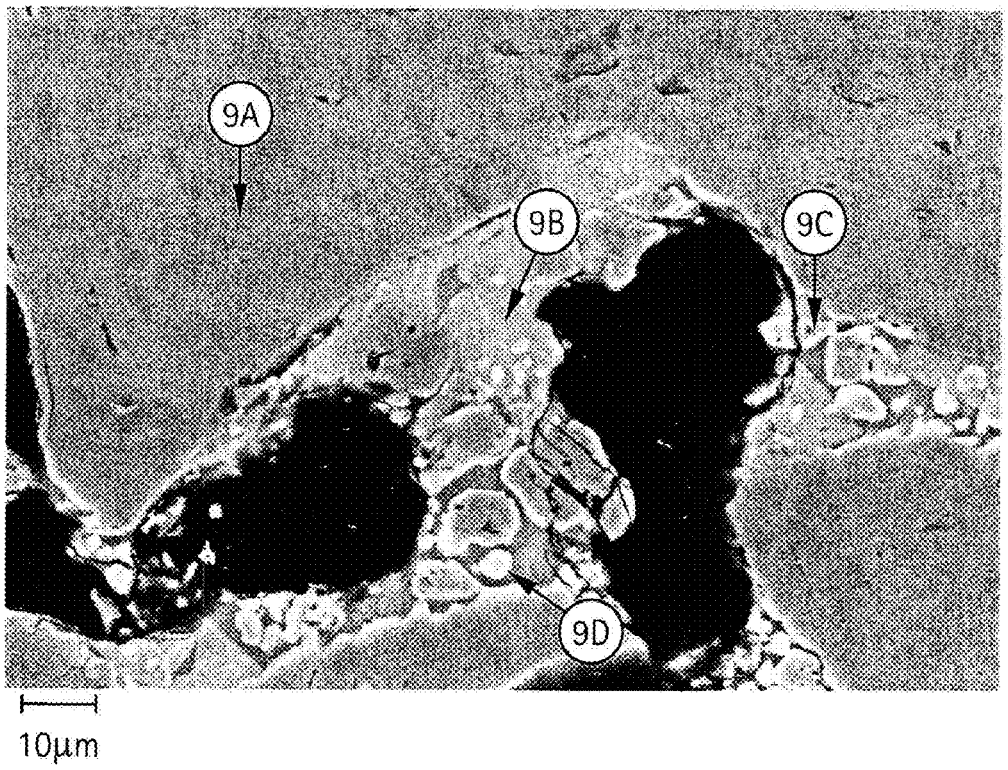
Figure 9A:
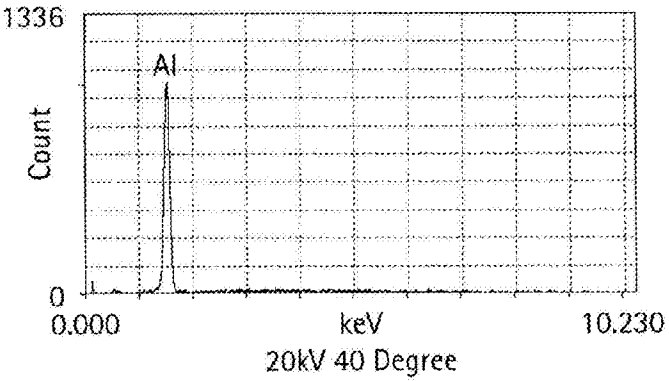
Figure 9B:
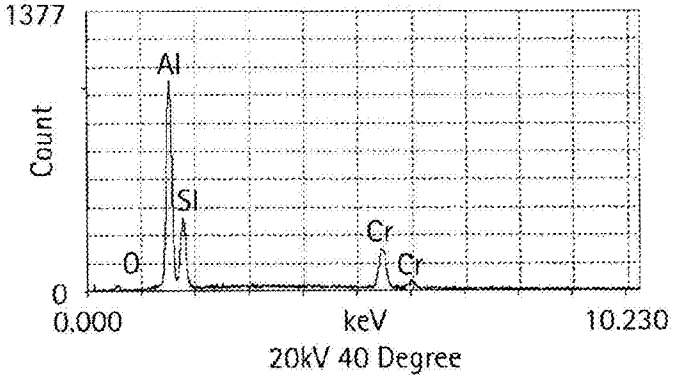
Figure 9C:
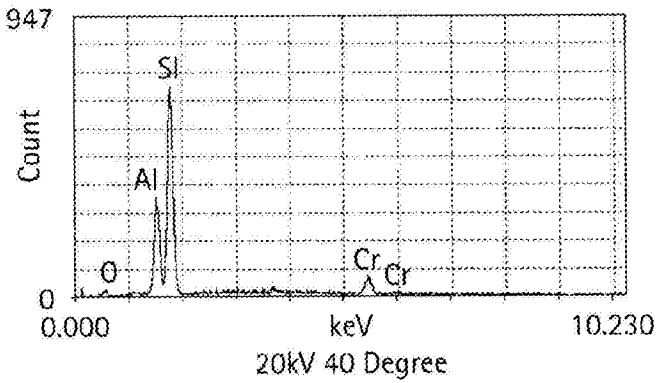
Figure 9D:
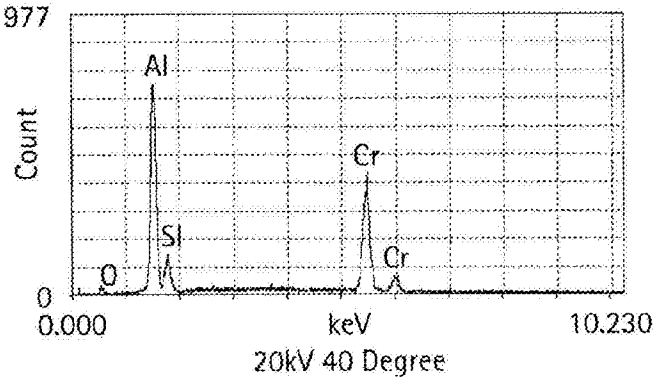
Figure 10:
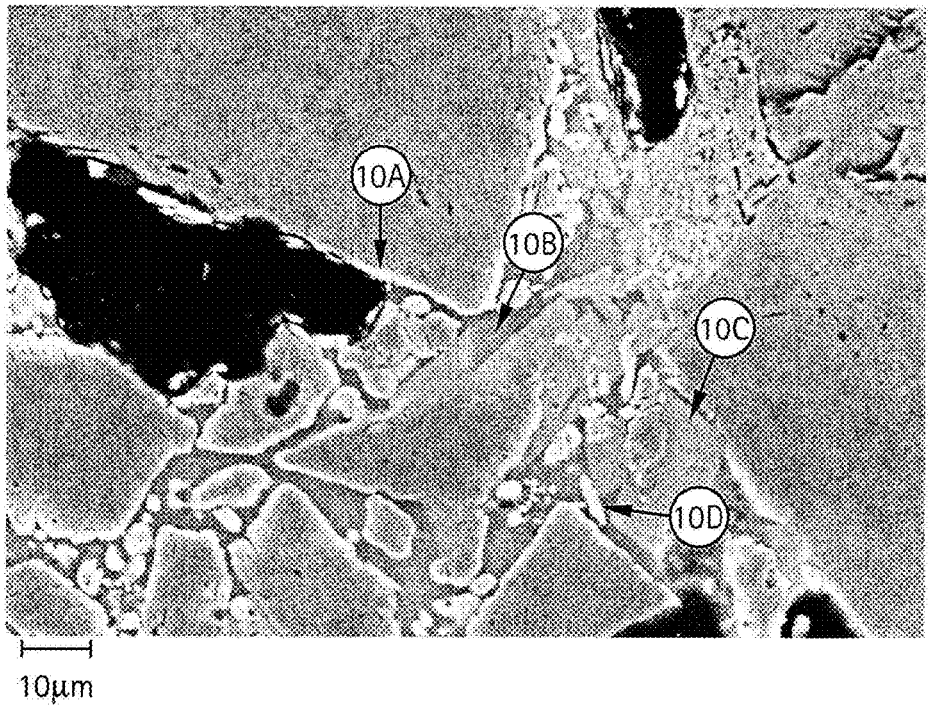
FIGS. 10-11 provides micrographs at two different resolutions illustrating grain microstructure of a shell mold formed from a slurry composition of aluminum oxide, 9% chromium oxide and silicon dioxide and further includes qualitative elemental analysis by energy dispersive X-ray spectroscopy for different regions of the microstructure.
Figure 10A:
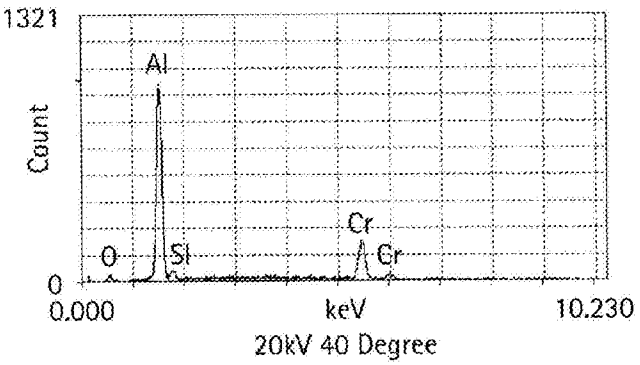
Figure 10B:
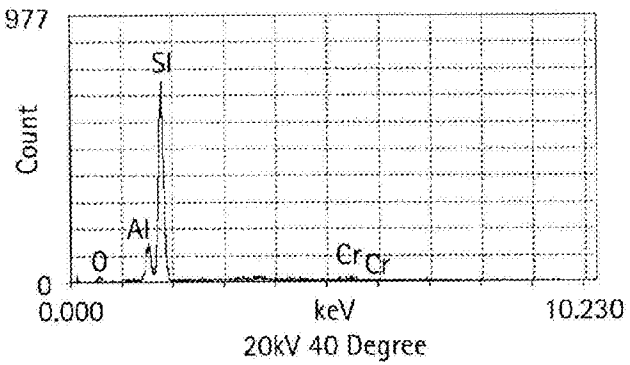
Figure 10C:
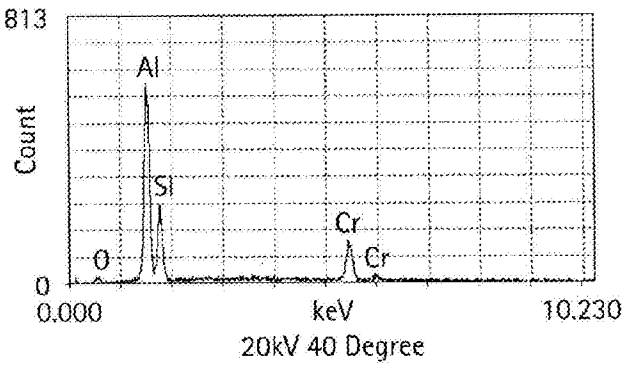
Figure 10D:
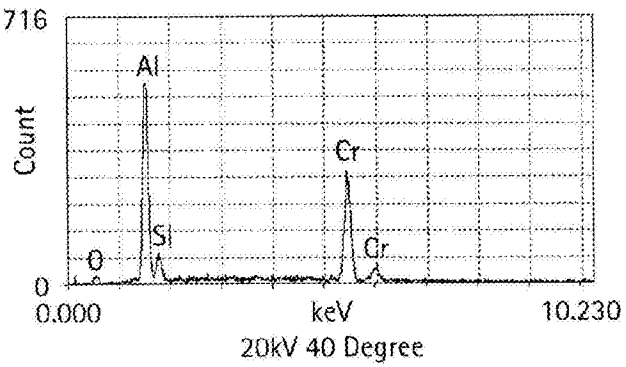
Figure 11:
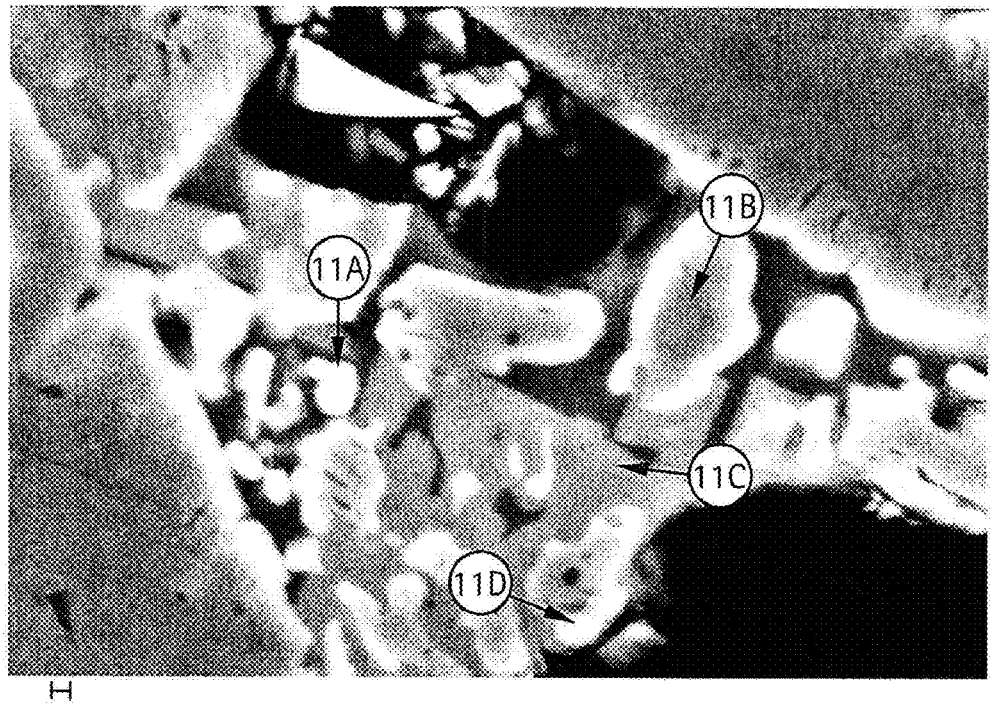
Figure 11A:
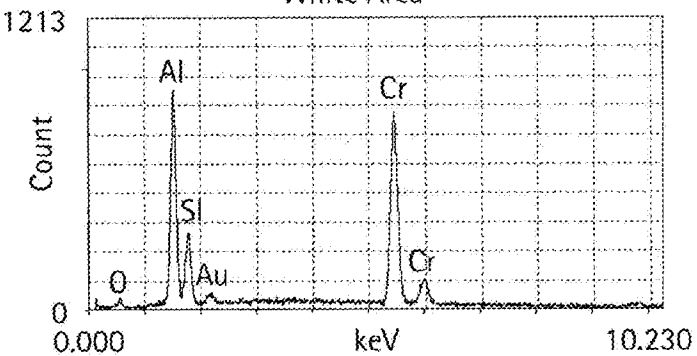
Figure 11B:
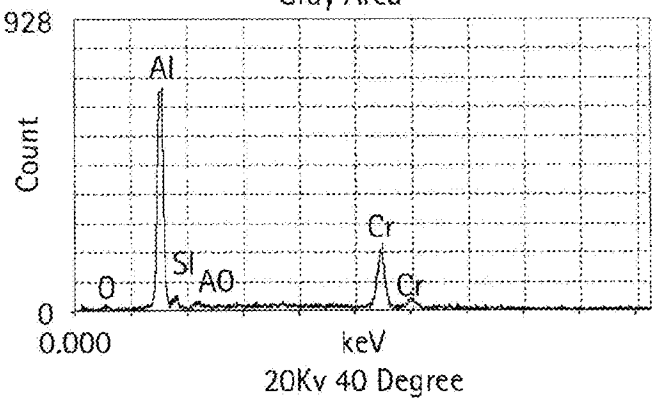
Figure 11C:
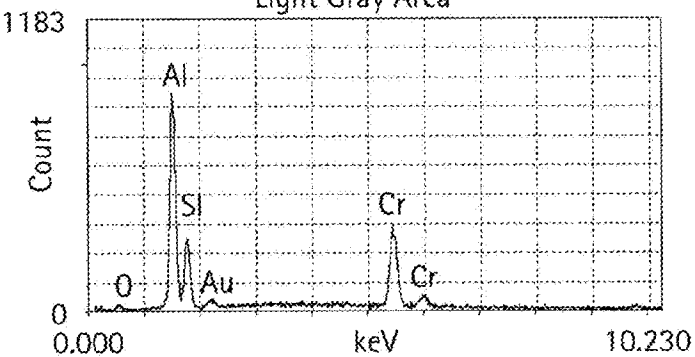
Figure 11D:
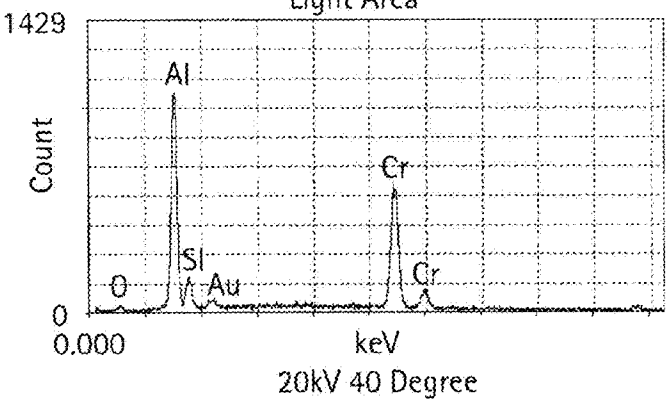

FIG. 4 graphically illustrates emittance (%) over a wavelength range for slurries with different amounts of chromia. As shown, molds that included $Cr_2O_3$ exhibited an increase in emittance. For molds containing 6% and 9% $Cr_2O_3$, the emittance from about 0.4 microns to about 4 microns wavelength was approximately 3 times greater than the control that did not contain any $Cr_2O_3$.

FIGS. 5-11 provide scanning electron micrographs including X-ray diffraction spectra corresponding to different regions within the microstructure. For the various compositions containing different amount of chromium oxide, micrographs at 1,500 and 5,000 times was examined.

EXAMPLE 2

In this example, a mold was prepared from a titanium dioxide-silica slurry ($TiO_2$—$SiO_2$) with an alumina stucco. The slurry was prepared by mixing titanium dioxide into colloidal silica. A shell was formed by dipping a fugitive pattern into the slurry and then sieving dry alumina grains onto the freshly dipped pattern. The steps of dipping the pattern into a refractory slurry and then sieving onto the freshly dipped pattern dry refractory grains may be repeated until the desired thickness of the shell is obtained. Each coat of slurry and grains were air-dried before subsequent coats are applied. The shell is then heated to a temperature of about 1000° C. for one hour to stabilize the shell and then further heated to a temperature of 1600° C. for one hour in a vacuum to form the mold.

Figure 12A:
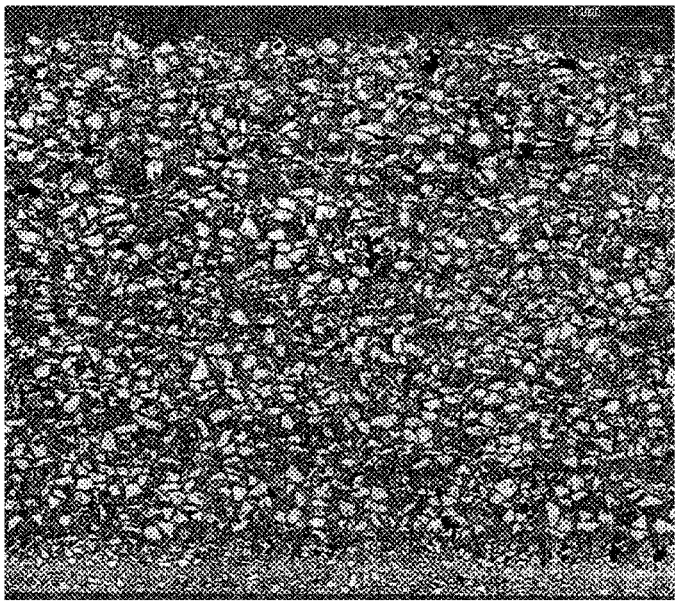
FIG. 12 provides a micrograph illustrating grain microstructure of a shell mold formed from a slurry composition of titanium dioxide, aluminum oxide, and silicon dioxide.
Figure 12B:
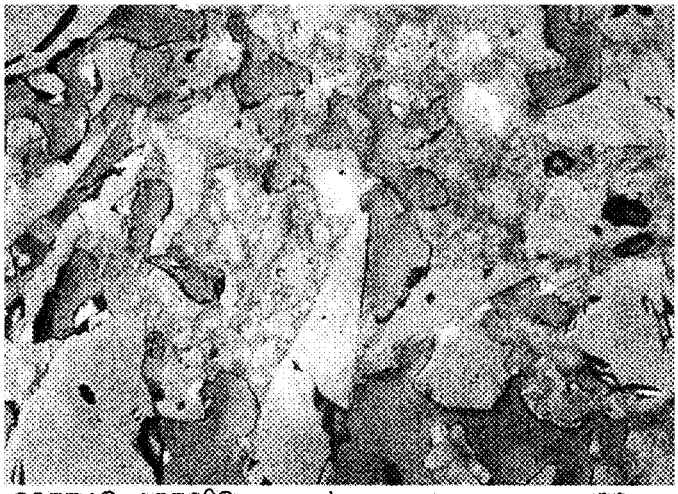
Figure 12C:
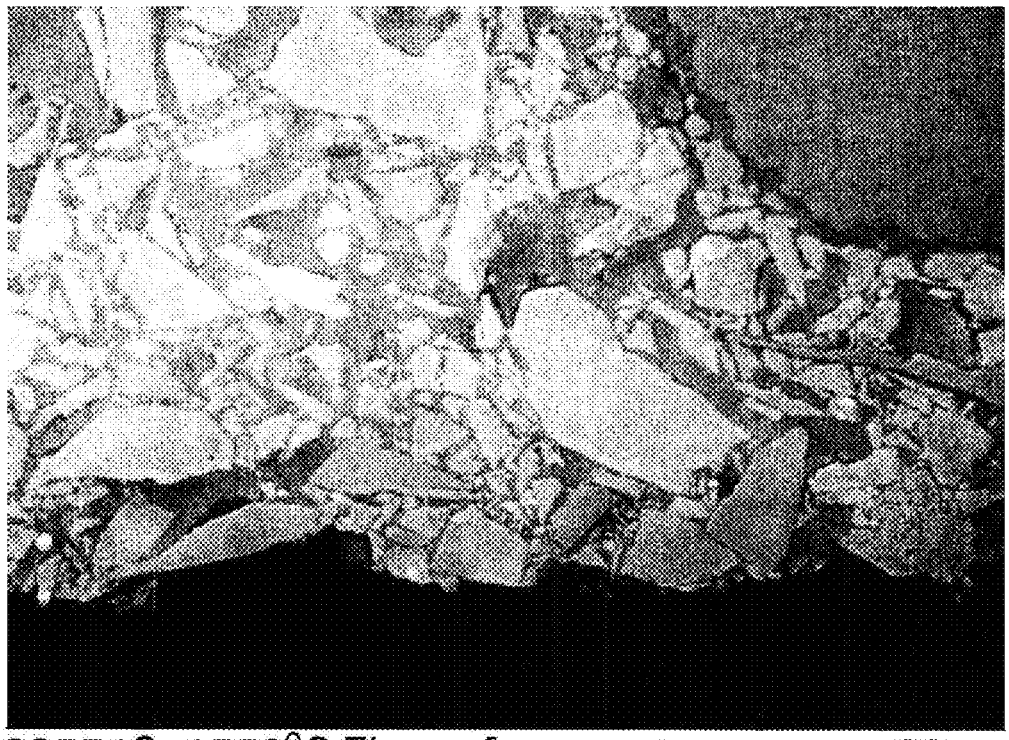

FIG. 12 pictorially illustrates cross sectional views of the mold showing the mold facecoat and as a secondary layer. Referring back to the ternary phase diagram of FIG. 2, zirconium silicate ($ZrSiO_4$) formed in the facecoat region as a consequence of the diffusion couple between the slurry composition and the $Al_2O_3$ stucco during heat treatment. The secondary facecoat is formed of alumina-zirconium oxide-silica.

Figure 13:
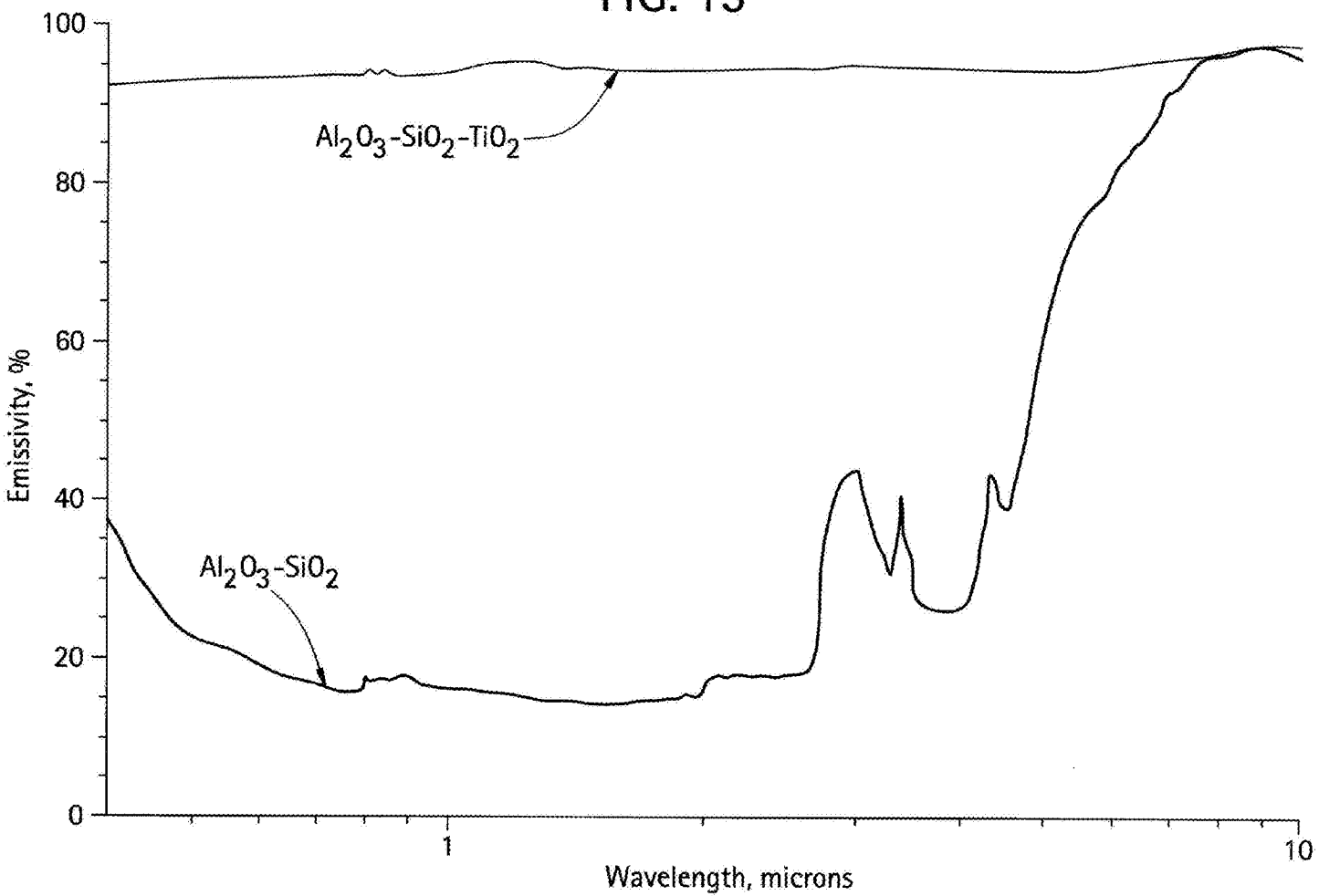
FIG. 13 graphically illustrates emittance as a function of wavelength for shell molds formed from a slurry composition of titanium dioxide and silicon dioxide with an aluminum oxide stucco.

FIG. 13 graphically illustrates emittance (%) over a wavelength range for this example 2 mold containing titanium dioxide and for the control mold of Example 1 that contained only alumina and silica. For the mold containing titanium dioxide, the emittance from about 0.4 microns to about 4 microns wavelength was up to about 6 times greater than the control mold.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A shell mold for casting molten material to form an article, comprising:

a facecoat disposed on an inner surface of the shell mold that contacts the molten material during use thereof, said facecoat having a phase comprising a high-emissivity alumina solid solution, wherein the high emissivity alumina solid solution is substantially mullite and corundum.

2. The shell mold of claim 1, wherein the alumina solid solution is formed from a slurry comprising aluminum oxide, green chromium oxide, and silicon oxide, wherein the aluminum oxide is in an amount of 70 to about 95 weight percent; the chromium oxide in an amount greater than 0 to about 9 weight percent, the silicon dioxide in an amount greater than 0 to about 27 weight percent, wherein the weight percents are based on total solids of the slurry.

3. The shell mold of claim 1, wherein the alumina solid solution is formed from a slurry further comprising titanium dioxide in an amount greater than 0 to about 9 weight percent.

4. The shell mold of claim 1, wherein the slurry further comprises a refractory material selected from a group consisting of, FeO, $Fe_2O_3$, $TiO_2$, TaC, TiC, SiC, HfC, ZrC, oxides thereof, and combinations thereof.

5. The shell mold of claim 1, wherein the shell mold further comprises an alumina stucco layer having an average particle size greater than 50 microns.

6. The shell mold of claim 1, wherein the facecoat comprises multiple layers, wherein each one of the multiple layers includes a stucco layer formed thereon, wherein the stucco layer comprises alumina.

7. The shell mold of claim 1, wherein a secondary layer set over the facecoat is compositionally graded.

8. The shell mold of claim 2, wherein the aluminum oxide in the slurry has a particle size of 10 microns to 300 microns, the green chromium oxide has a particle size of 10 microns to 300 microns, and the silicon dioxide has a particle size of 5 nanometers to 10 microns.

9. The shell mold of claim 1, wherein the alumina solid solution is formed from a slurry comprising aluminum oxide, green chromium oxide, white titanium oxide, and silicon oxide, wherein the aluminum oxide is in an amount of 70 to about 95 weight percent; the white titanium oxide and the green chromium oxide are each in an amount greater than 0 to about 9 weight percent, the silicon dioxide in an amount greater than 0 to about 27 weight percent, wherein the weight percents are based on total solids of the slurry.

* * * * *

UNITED STATES PATENT AND TRADEMARK OFFICE

CERTIFICATE OF CORRECTION

PATENT NO. : 8,033,320 B2
APPLICATION NO. : 12/179749
DATED : October 11, 2011
INVENTOR(S) : Gigliotti et al.

It is certified that error appears in the above-identified patent and that said Letters Patent is hereby corrected as shown below:

In Fig. 3, Sheet 3 of 21, delete "  " and insert -- 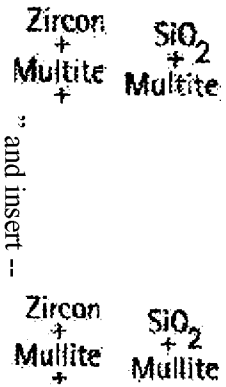 --, therefor.

In Fig. 3, Sheet 3 of 21, delete " 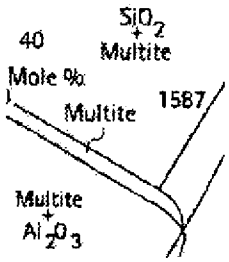 " and insert -- 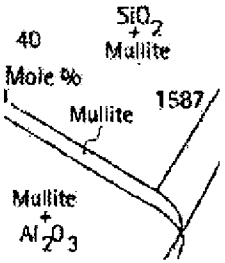 --, therefor.

Signed and Sealed this
Twenty-seventh Day of March, 2012

David J. Kappos

David J. Kappos
*Director of the United States Patent and Trademark Office*